US008496502B2

(12) United States Patent
Orner

(10) Patent No.: US 8,496,502 B2
(45) Date of Patent: Jul. 30, 2013

(54) COAXIAL CABLE CONNECTOR

(75) Inventor: Jeffrey K. Orner, Boiling Springs, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/151,472

(22) Filed: Jun. 2, 2011

(65) Prior Publication Data

US 2012/0309226 A1 Dec. 6, 2012

(51) Int. Cl.
*H01R 13/24* (2006.01)

(52) U.S. Cl.
USPC ..... 439/700

(58) Field of Classification Search
USPC ..... 439/427, 394, 700, 675, 584, 578
See application file for complete search history.

(56) References Cited

U.S. PATENT DOCUMENTS

| | | | | |
|---|---|---|---|---|
| 4,355,857 | A * | 10/1982 | Hayward | 439/578 |
| 6,575,784 | B1 | 6/2003 | Yamada | |
| 6,705,884 | B1 * | 3/2004 | McCarthy | 439/394 |
| 6,835,095 | B2 * | 12/2004 | Chen | 439/578 |
| 7,275,957 | B1 | 10/2007 | Wlos et al. | |
| 7,347,729 | B2 | 3/2008 | Thomas et al. | |
| 7,435,135 | B2 | 10/2008 | Wlos | |

* cited by examiner

*Primary Examiner* — Phuong Dinh

(57) ABSTRACT

A coaxial cable connector includes a shell that extends between a mating end and a cable end. The cable end is configured to be terminated to an end of a coaxial cable. A dielectric insert is held within the shell. An inner contact is held within the dielectric insert. The inner contact has a spring loaded pin that is configured to be spring loaded against a center conductor of the coaxial cable.

20 Claims, 2 Drawing Sheets

COAXIAL CABLE CONNECTOR

BACKGROUND OF THE INVENTION

The subject matter herein relates generally to coaxial cable connectors.

Coaxial cable connectors are commonly used to terminate coaxial cables and provide an electrical connection to a mating coaxial cable connector. The coaxial cable connector includes a metallic shell having a cylindrical sleeve. Centrally disposed within the sleeve is an inner contact. The inner contact is maintained in coaxial alignment with the sleeve by means of an optimized dielectric.

Past coaxial cable connector designs have been complex and have utilized costly manufacturing procedures. The individual parts are often assembled by several hand assembling steps to form the final connector. For example, conventional coaxial cables typically include a center conductor surrounded by an insulator. A conductive foil is disposed over the insulator and a cable braid surrounds the foil covered insulator. An outer insulative jacket surrounds the cable braid. In order to prepare the coaxial cable for termination, the outer jacket is stripped back exposing a portion of the cable braid, which is folded back over the jacket. A portion of the insulator extends outwardly from the jacket. The insulator is stripped to expose a portion of the center conductor extending outwardly from within the insulator. Upon assembly of a coaxial cable connector to the coaxial cable, the inner contact of the connector is crimped to the center conductor of the coaxial cable, and the outer shell of the connector is crimped to the conductive cable braid at the end of the coaxial cable. The process of preparing an end of a coaxial cable for installation into a connector requires a skilled operator and is time consuming.

A need exists to provide a coaxial cable connector which eliminates the need to prepare an end of a coaxial cable. A need exists to provide an inexpensive coaxial connector that requires minimal assembly steps.

BRIEF DESCRIPTION OF THE INVENTION

In one embodiment, a coaxial cable connector is provided having a shell that extends between a mating end and a cable end. The cable end is configured to be terminated to an end of a coaxial cable. A dielectric insert is held within the shell. An inner contact is held within the dielectric insert. The inner contact has a spring loaded pin that is configured to be spring loaded against a center conductor of the coaxial cable.

Optionally, the inner contact may include a front contact configured to be mated to a corresponding mating contact of a mating connector with the spring loaded pin being moveably coupled to the front contact. The front contact may have a central bore with a spring received in the central bore. The spring may press against the spring loaded pin to push the spring loaded pin away from the front contact.

Optionally, the spring loaded pin may include a pointed tip configured to pierce the center conductor of the coaxial cable. The spring loaded pin may include a pin body with the pointed tip being pressed into the center conductor of the coaxial cable such that the pin body engages the center conductor.

Optionally, the shell may be manufactured from a metal material to provide electrical shielding around the inner contact. The shell may be configured to be electrically connected to a cable braid of the coaxial cable. The spring loaded pin may be moveable along a connector axis of the coaxial cable connector.

Optionally, the cable end may include a collet configured to be electrically connected to a cable braid of the coaxial cable. The collet may have a plurality of barbs separated by slots. The coaxial cable connector may include a retention nut coupled to the cable end. The retention nut may surround the end of the coaxial cable and be threadably coupled to external threads of the shell. The barbs may be pressed radially inward by the retention nut when the retention nut is coupled to the cable end. The barbs may pierce an outer jacket of the coaxial cable to engage a cable braid of the coaxial cable. The retention nut may have a front portion and a rear portion and a central bore therethrough having a generally cylindrical shape along the front portion and a frustoconical shape along the rear portion. The central bore may be defined by an inner surface that is tapered at the rear portion. The tapered inner surface may engage the barbs and cause the barbs to deflect inward into the end of the coaxial cable.

In another embodiment, a coaxial cable connector is provided having a shell that extends between a mating end and a cable end. The cable end has a collet that is configured to be mechanically secured to an end of a coaxial cable. The collet is configured to be electrically connected to a cable braid of the coaxial cable. A dielectric insert held within the shell. An inner contact is held within the dielectric insert. The inner contact has a spring loaded pin that is configured to be spring loaded against a center conductor of the coaxial cable.

DETAILED DESCRIPTION OF THE INVENTION

Figure 1:
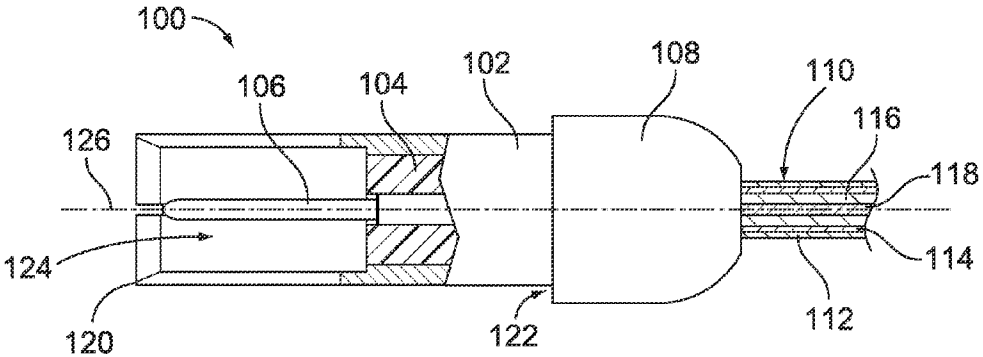
FIG. 1 is a partial sectional view a coaxial cable connector formed in accordance with an exemplary embodiment.

FIG. 1 is a partial sectional view a coaxial cable connector 100 formed in accordance with an exemplary embodiment. The coaxial cable connector 100 includes an outer metal shell 102, a dielectric insert 104 received and secured within the shell 102, a inner contact 106 which is received within the dielectric insert 104, and a retention nut 108, all secured to a coaxial cable 110. The coaxial cable connector 100 is configured to be pressed onto an end of a coaxial cable 110 without needing to strip or otherwise prepare the coaxial cable 110. The coaxial cable 110 is cut to length, providing a flat, cut end that is loaded into the shell 102 and secured using the retention nut 108, as described in further detail below.

The coaxial cable 110 has an outer jacket 112 surrounding a cable braid 114, which surrounds an insulator 116 and a center conductor 118. The insulator 116 electrically isolates the center conductor 118 from the cable braid 114. The cable braid 114 provides electrical shielding for the center conductor 118.

The shell 102 has a forwardly facing mating end 120 and a rearwardly facing cable end 122. The cable end 122 is terminated to an end of the coaxial cable 110. The retention nut 108 is coupled to the cable end 122 to secure the coaxial cable connector 100 to the end of the coaxial cable 110. The shell 102 is manufactured from a metal material and provides electrical shielding around the inner contact 106. The shell 102 is configured to be electrically connected the cable braid 114 of the coaxial cable 110. The shell 102 is generally cylindrical in shape. The shell 102 has an internal passageway 124 extending along a connector axis 126. The mating end 120 is configured to receive a mating connector (not shown) in the internal passageway 124.

The dielectric insert 104 and inner contact 106 are held in the internal passageway 124. For example, the dielectric insert 104 is secured within the internal passageway 124 and the inner contact 106 is secured within the dielectric insert 104. The inner contact 106 extends along the connector axis 126. The inner contact 106 is positioned within the internal passageway 124 at the mating end 120 for mating with a corresponding mating contact (not shown) of the mating connector. The mating end 120 may have a different mating interface for mating with a different type of mating connector in an alternative embodiment.

Figure 2:
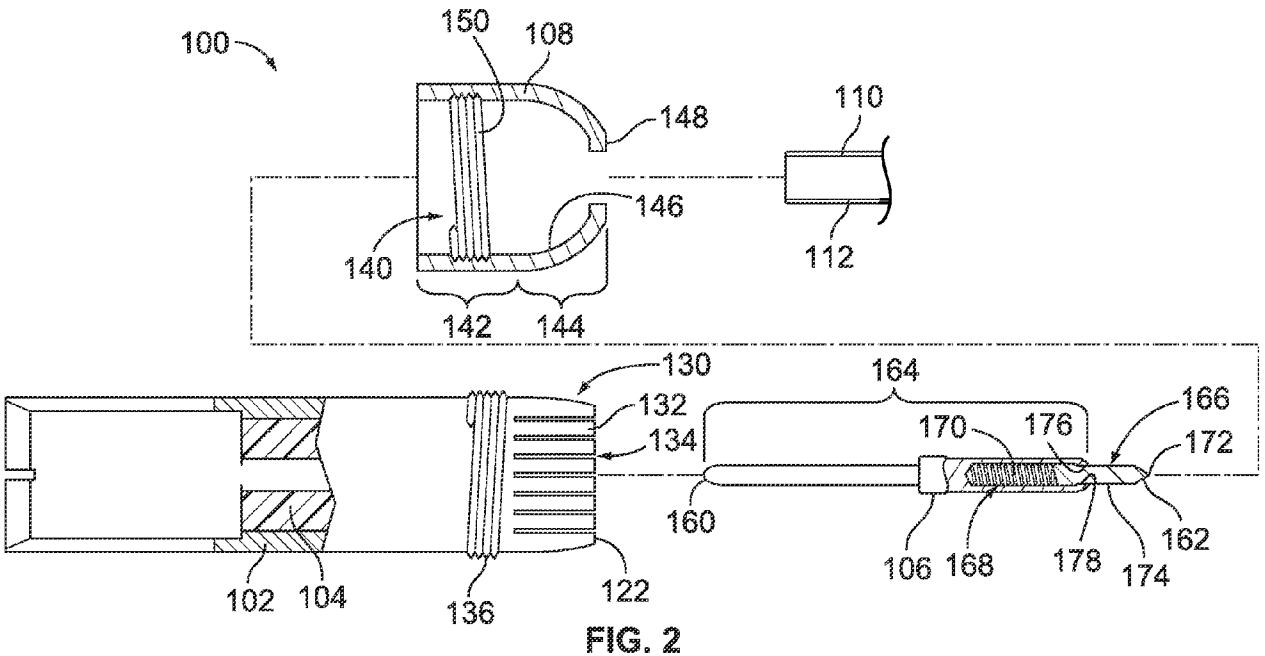
FIG. 2 is an exploded, partial sectional view, of the coaxial cable connector shown in FIG. 1.

FIG. 2 is an exploded, partial sectional view, of the coaxial cable connector 100. The front of the outer metal shell 102 is shown in cross section. The rear of the inner contact 106 is shown in cross section. The retention nut 108 is shown in cross section.

The shell 102 includes a collet 130 at the cable end 122. The collet 130 is defined by a plurality of barbs 132 separated by slots 134. The collet 130 is compressible to secure the cable end 122 to the coaxial cable 110. For example, the barbs 132 may be deflected inwardly to press against the end of the coaxial cable 110. In an exemplary embodiment, the ends of the barbs 132 may pierce through the outer jacket 112 of the coaxial cable 110 to engage the cable braid 114 (shown in FIG. 1). Optionally, the barbs 132 may pierce the cable braid 114 in addition to the outer jacket 112. The barbs 132 engage the cable braid 114 to electrically connect the outer metal shell 102 to the cable braid 114 of the coaxial cable 110.

The shell 102 includes external threads 136 proximate to the cable end 122. The external threads 136 are positioned forward of the collet 130. The external threads 136 are used to threadably connect the retention nut 108 to the cable end 122 of the shell 102. Other securing features may be used in alternative embodiments to secure the retention nut 108 to the cable end 122 of the shell 102.

The retention nut 108 has a central bore 140 extending therethrough. The retention nut 108 has a front portion 142 and a rear portion 144. The central bore 140 extends along the front portion 142 and the rear portion 144. The central bore 140 has a generally cylindrical shape along the front portion 142. The central bore 140 has a frustoconical shape along the rear portion 144. The central bore 140 is defined by an inner surface 146 of the retention nut 108. The inner surface 146 is generally cylindrical along the front portion 142. The inner surface 146 is generally tapered inward at the rear portion 144. For example, the inner surface 146 is tapered inward from the front portion 142 to a back end 148 of the retention nut 108.

The tapered inner surface 146 is configured to engage the barbs 132 when the retention nut 108 is coupled to the shell 102. The tapered inner surface 146 causes the barbs 132 to deflect inward toward and into the end of the coaxial cable 110, securing the coaxial cable connector 100 to the coaxial cable 110. The retention nut 108 includes internal threads 150 at the front portion 142. The internal threads 150 engage the external threads 136 to secure the retention nut 108 to the shell 102.

The retention nut 108 is configured to be threadably coupled to the cable end 122 of the shell 102. As the retention nut 108 is tightened on the shell 102, the retention nut 108 is drawn forward causing the tapered rear portion 144 to engage the barbs 132 of the collet 130. Further tightening of the retention nut 108 causes the barbs 132 to deflect further radially inward toward the coaxial cable 110. When the retention nut 108 is fully mated with the shell 102, the barbs 132 are tightly pressed against the end of the coaxial cable 110 to secure the coaxial cable connector 100 to the coaxial cable 110. In an exemplary embodiment, the inner surface 146 of the retention nut 108 forces the barbs 132 to pierce the outer jacket 112 of the coaxial cable 110 such that the distal ends of the barbs 132 engage the cable braid 114 to electrically connect the cable braid 114 to the shell 102.

During assembly, the retention nut 108 is initially loaded over the end of the coaxial cable 110. The end of the coaxial cable 110 is then loaded into the cable end 122 of the outer metal shell 102. Once positioned, the retention nut 108 may then slide over the cable end 122 from behind the cable end 122. The retention nut 108 is secured to the cable end 122, forcing the collet 130 to mechanically and electrically engage the coaxial cable 110.

The inner contact 106 extends between a mating end 160 and a cable end 162. The mating end 160 is configured to engage a corresponding mating contact of a mating connector. The cable end 162 is configured to be terminated to the center conductor 118 (shown in FIG. 1) of the coaxial cable 110. The inner contact 106 is terminated to the center conductor 118 by pressing the inner contact 106 against the center conductor 118. In an exemplary embodiment, the inner contact 106 is spring loaded against the center conductor 118 to maintain electrical contact with the center conductor 118. The inner contact 106 includes a front contact 164 and a spring loaded pin 166 moveably coupled to the front contact 164. The spring loaded pin 166 is configured to be spring loaded against the center conductor 118 of the coaxial cable 110. The front contact 164 is positioned forward of the spring loaded pin 166. The front contact 164 defines the mating end 160. The spring loaded pin 166 defines the cable end 162. The front contact 164 has a central bore 168. The inner contact 106 includes a spring 170 held in the central bore 168 between the front contact 164 and the spring loaded pin 166. The spring 170 presses against the pin 166 to push the pin 166 away from the front contact 164.

The spring loaded pin 166 includes a pin body 174 extending rearward to a tip 172. In an exemplary embodiment, the tip 172 is pointed. In another embodiment, the tip 172 is thinned to have a razor or cutting edge for cutting into the center conductor 118. Optionally, the tip 172 may be serrated to cut into the center conductor 118. The pin body 174 may be knurled.

The front contact 164 has a collar 176 at the back end of the front contact 164. The collar 176 holds the spring loaded pin 166 in the central bore 168. The pin body 174 has a shoulder 178 that engages the collar 176 to prevent the pin 166 from exiting the central bore 168. The pin 166 may be pressed into the central bore 168 in a forward direction, such as when the coaxial cable 110 is loaded into the shell 102. As the pin 166 is pressed into the central bore 168, the spring 170 is compressed increasing the spring force on the pin 166.

Figure 3:
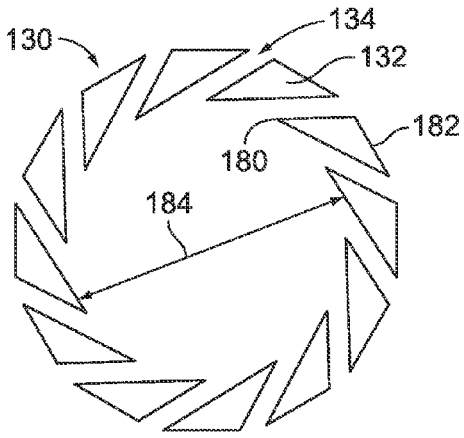
FIG. 3 is a cross sectional view a portion of the coaxial cable connector shown in FIG. 2 showing a collet of the coaxial cable connector in an expanded state.

FIG. 3 is a cross sectional view of the shell 102 taken through the collet 130 (shown in FIG. 2). FIG. 3 illustrates the collet 130 in a normal or expanded state where the barbs 132 are spread apart. The barbs 132 are spread apart from one another with the slots 134 defined therebetween. The barbs 132 have inner edges 180 and outer edges 182. The inner edges 180 may be relatively thin (e.g., like an edge of a knife) for piercing the outer jacket 112 (shown in FIG. 1) of the coaxial cable 110 (shown in FIG. 1). When the barbs 132 are compressed, the inner edges 180 are forced inward and may pierce the outer jacket 112. In the expanded state, the collet 130 has a diameter 184 that is larger than a diameter of the outer jacket 112, such that the coaxial cable 110 may be loaded into the shell 102.

Figure 4:
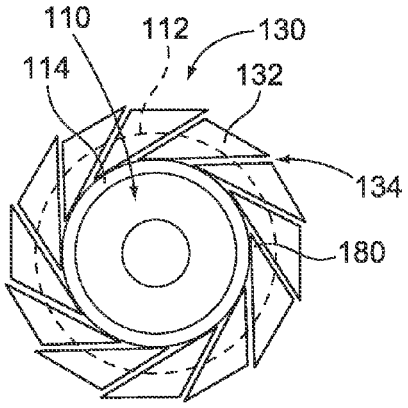
FIG. 4 is a cross sectional view of a portion of the coaxial cable connector shown in FIG. 2 showing a collet of the coaxial cable connector in an compressed state.

FIG. 4 is a cross sectional view of the shell 102 taken through the collet 130. FIG. 4 illustrates the collet 130 secured to the coaxial cable 110. The barbs 132 are shown in a compressed state in which the barbs 132 are pressed inward by the retention nut 108 (shown in FIG. 1). When the barbs 132 are compressed, the inner edges 180 pierce through the outer jacket 112 (shown in phantom in FIG. 4) and engage the cable braid 114. Optionally, the inner edges 180 may pierce the cable braid 114 in addition to the outer jacket 112. The barbs 132 are electrically connected to the cable braid 114 by the engagement between the inner edges 180 and the cable braid 114. In the compressed state, the barbs 132 may engage one another. The barbs 132 may be compressed such that the slots 134 are partially or fully closed. In the compressed state, the collet 130 exerts a strong clamping force on the coaxial cable 110 to secure the coaxial cable connector 100 to the coaxial cable 110.

Figure 5:
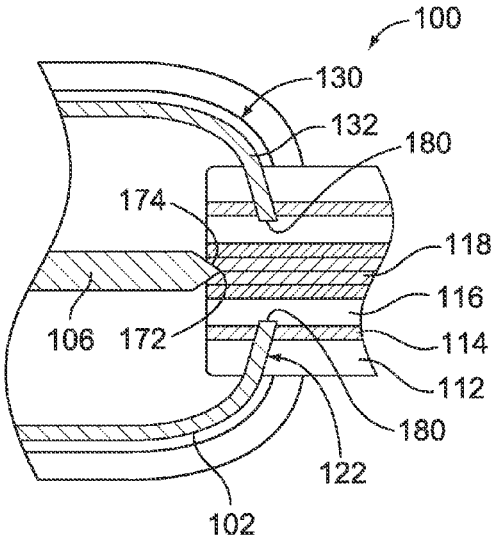
FIG. 5 is a cross sectional view of a portion of the coaxial cable connector shown in FIG. 1 secured to a coaxial cable.

FIG. 5 is a cross sectional view of a portion of the coaxial cable connector 100 secured to the coaxial cable 110. The cable end 122 of the shell 102 is illustrated in FIG. 5. In the illustrated embodiment, the center conductor 118 of the coaxial cable 110 includes a plurality of conductors or strands that are held together to define the center conductor 118. The tip 172 of the inner contact 106 is pressed into the center conductor 118 such that the tip 172 is positioned between individual strands of the center conductor 118. The pin body 174 engages multiple strands of the center conductor 118 to ensure good electrical contact between the inner contact 106 and the center conductor 118. The barbs 132 of the collet 130 are illustrated piercing through the outer jacket 112 to engage the cable braid 114. Optionally, the barbs 132 may pierce the cable braid 114. Alternatively, the inner edge 180 of the barb 132 may engage and press against the cable braid 114.

Figure 6:
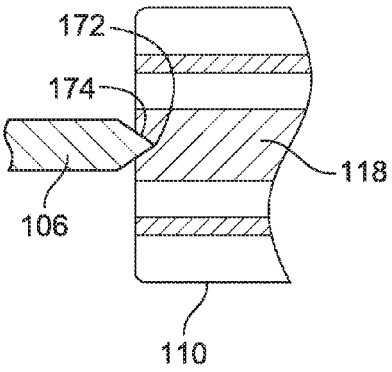
FIG. 6 is a cross sectional view of a portion of the coaxial cable connector shown in FIG. 1 secured to a coaxial cable.

FIG. 6 is a cross sectional view of a portion of the coaxial cable connector 100 and the coaxial cable 110. FIG. 6 illustrates an alternative center conductor 118. The center conductor 118 is a solid conductor, as opposed to the plurality of strands as shown in the embodiment of FIG. 5. The tip 172 of the inner contact 106 includes a sharp edge that cuts into the center conductor 118. The pin body 174 engages the center conductor 118 to ensure electrical contact between the inner contact 106 and the center conductor 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A coaxial cable connector comprising:

a shell extending between a mating end and a cable end, the cable end including a collet having a plurality of barbs separated by slots, the collet being configured to be electrically terminated to a cable braid at an end of a coaxial cable;

a dielectric insert held within the shell;

an inner contact held within the dielectric insert, the inner contact having a spring loaded pin configured to be spring loaded against a center conductor of the coaxial cable; and a retention nut coupled to the cable end, the retention nut engaging the collet to press the barbs radially inward as the retention nut is tightened to the cable end, wherein the barbs are configured to pierce an outer jacket of the coaxial cable as the retention nut is tightened to engage the cable braid of the coaxial cable.

2. The coaxial cable connector of claim 1, wherein the inner contact includes a front contact configured to be mated to a corresponding mating contact of a mating connector, the spring loaded pin being moveably coupled to the front contact.

3. The coaxial cable connector of claim 1, wherein the inner contact includes a front contact configured to be mated to a corresponding mating contact of a mating connector, the front contact having a central bore, the inner contact having a spring received in the central bore, the spring pressing against the spring loaded pin to push the spring loaded pin away from the front contact.

4. The coaxial cable connector of claim 1, wherein the spring loaded pin includes a pointed tip and a pin body, the pointed tip being configured to press into the center conductor of the coaxial cable such that the pin body engages the center conductor.

5. The coaxial cable connector of claim 1, wherein the shell is manufactured from a metal material and provides electrical shielding around the inner contact, the shell being configured to be electrically connected to the cable braid of the coaxial cable via the collet.

6. The coaxial cable connector of claim 1, wherein the barbs are configured to pierce the cable braid of the coaxial cable.

7. The coaxial cable connector of claim 1, wherein the shell has external threads, the retention nut being threadably coupled to the external threads of the shell.

8. The coaxial cable connector of claim 1, the retention nut having a front portion and a rear portion, the retention nut having a central bore therethrough, the central bore having a generally cylindrical shape along the front portion, the central bore having a frustoconical shape along the rear portion.

9. The coaxial cable connector of claim 1, the retention nut having a front portion and a rear portion, the retention nut having a central bore therethrough, the central bore being defined by an inner surface, the inner surface being tapered at the rear portion, the tapered inner surface engaging the barbs and causing the barbs to deflect inward into the end of the coaxial cable.

10. The coaxial cable connector of claim 1, wherein the barbs include inner edges that pierce through the outer jacket, the barbs overlapping one another such that the inner edge of one barb is overlapped by and pressed inward by an adjacent barb.

11. A coaxial cable connector comprising:

a shell extending between a mating end and a cable end, the cable end having a collet configured to be mechanically secured to an end of a coaxial cable, the collet being configured to be electrically connected to a cable braid of the coaxial cable;

a dielectric insert held within the shell; and an inner contact held within the dielectric insert, the inner contact having a spring loaded pin configured to be spring loaded against a center conductor of the coaxial cable, the spring loaded pin having a pointed tip configured to pierce the center conductor.

12. The coaxial cable connector of claim 11, wherein the collet includes a plurality of barbs separated by slots, the coaxial cable connector further comprising a retention nut coupled to the cable end, the barbs being pressed radially inward by the retention nut when the retention nut is coupled to the cable end.

13. The coaxial cable connector of claim 11, wherein the collet includes a plurality of barbs separated by slots, the barbs being configured to pierce an outer jacket of the coaxial cable to engage a cable braid of the coaxial cable.

14. The coaxial cable connector of claim 11, wherein the collet includes a plurality of barbs separated by slots, the coaxial cable connector further comprising a retention nut coupled to the cable end, the retention nut having a front portion and a rear portion, the collet having a central bore therethrough, the central bore having a generally cylindrical shape along the front portion, the central bore having a frustoconical shape along the rear portion.

15. The coaxial cable connector of claim 11, wherein the collet includes a plurality of barbs separated by slots, the coaxial cable connector further comprising a retention nut coupled to the cable end, the retention nut having a front portion and a rear portion, the collet having a central bore therethrough, the central bore being defined by an inner surface, the inner surface being tapered at the rear portion, the tapered inner surface engaging the barbs and causing the barbs to deflect inward into the end of the coaxial cable.

16. The coaxial cable connector of claim 11, wherein the inner contact includes a front contact configured to be mated to a corresponding mating contact of a mating connector, the front contact having a central bore, the inner contact having a spring received in the central bore, the spring pressing against the spring loaded pin to push the spring loaded pin away from the front contact.

17. The coaxial cable connector of claim 11, wherein the spring loaded pin includes a pin body extending away from the pointed tip, the pointed tip being configured to press into the center conductor of the coaxial cable such that the pin body is received within and engages the center conductor.

18. A coaxial cable connector comprising:

a shell extending between a mating end and a cable end, the cable end including a collet having a plurality of barbs separated by slots, the collet being configured to pierce through a cable braid at an end of a coaxial cable to electrically terminate the collet to the cable braid;

a dielectric insert held within the shell; and an inner contact held within the dielectric insert, the inner contact having a spring loaded pin configured to be spring loaded against a center conductor of the coaxial cable.

19. The coaxial cable connector of claim 18, further comprising a retention nut threadably coupled to the cable end, the retention nut engaging the collet, the retention nut pressing the barbs radially inward as the retention nut is tightened to force the barbs to pierce through the cable braid as the retention nut is tightened.

20. The coaxial cable connector of claim 18, wherein the barbs include inner edges that pierce through the cable braid, the barbs overlapping one another such that the inner edge of one barb is overlapped by and pressed inward by an adjacent barb.

* * * * *